US011686549B1

(12) United States Patent
Chu et al.

(10) Patent No.: US 11,686,549 B1
(45) Date of Patent: Jun. 27, 2023

(54) CABLE SLIDE STRUCTURE OF CROSSBOW

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/706,753

(22) Filed: Mar. 29, 2022

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123; F41B 5/14
USPC ..... 124/25, 86
See application file for complete search history.

(56) References Cited

U.S. PATENT DOCUMENTS 5,119,797 A * 6/1992 Anderson ..... F41B 5/143 124/44.5
6,651,641 B1 * 11/2003 Bower ..... F41B 5/1407 124/92
8,622,050 B2 * 1/2014 Goff ..... F41B 5/12 124/35.2
8,627,811 B1 * 1/2014 Darlington ..... F41B 5/1426 124/90
8,656,899 B2 * 2/2014 Bednar ..... F41B 5/12 124/90
8,671,923 B2 * 3/2014 Goff ..... F41B 5/1469 124/25
8,991,375 B2 * 3/2015 McPherson ..... F41B 5/105 124/24.1
9,068,791 B2 * 6/2015 McPherson ..... F41B 5/148
9,200,863 B2 * 12/2015 Bednar ..... F41B 5/12
9,500,433 B2 * 11/2016 McPherson ..... F41B 5/1403
9,671,189 B2 * 6/2017 McPherson ..... F41B 5/123
9,879,939 B2 * 1/2018 McPherson ..... F41B 5/1411
10,145,641 B2 * 12/2018 Hout ..... F41B 5/1403
10,209,028 B2 * 2/2019 Bofill ..... F41B 5/123
10,739,104 B1 * 8/2020 Smith ..... F41B 5/123
10,962,322 B2 * 3/2021 Yehle ..... F41B 5/066
11,156,430 B2 * 10/2021 Smith ..... F41B 5/123
2010/0116259 A1 * 5/2010 Popov ..... F41B 5/123 124/25
2011/0030666 A1 * 2/2011 Darlington ..... F41B 5/105 124/25

* cited by examiner

*Primary Examiner* — Alexander R Niconovich
(74) *Attorney, Agent, or Firm* — Karin L. Williams; Mayer & Williams PC

(57) ABSTRACT

A cable slide structure of a crossbow, wherein the crossbow contains a crossbow body, a bow limb assembly, two pulley assemblies, a bowstring, two auxiliary strings, and a cable slide. The crossbow body includes a holder and a slot, and the bow limb assembly is fixed on the crossbow body. The two pulley assemblies are connected to two edges of the bow limb assembly, and two ends of the bowstring are connected with the two pulley assemblies. Each of the two auxiliary strings includes a first connection segment formed on a first end thereof, and each of the two auxiliary strings includes a second connection segment formed on a second end thereof. Two first connection segments of the two auxiliary strings are connected with the two pulley assemblies. The cable slide is slidably received in the slot and includes two opposite first fixing portions and two opposite second fixing portions.

6 Claims, 13 Drawing Sheets

CABLE SLIDE STRUCTURE OF CROSSBOW

BACKGROUND OF THE INVENTION

Field of the Invention

The present invention relates to a crossbow, and more particularly to a cable slide structure of the crossbow.

Description of the Prior Art

Modern crossbows include two types: a recurve crossbow and a compound crossbow. The recurve crossbow includes a crossbow body, a bow limb assembly at a front of the crossbow body, and a bowstring connected to two ends of the bow limb assembly. The bow limb assembly extends laterally from two sides of the crossbow body, and an extending length of the bow limb assembly forms a horizontal volume of the crossbow, which will cause a great trouble to a user who carries the crossbow, especially in woods or small spaces. A horizontal bow limb assembly is easy to hinder or even restrict the user's movement. A difference of the compound crossbow from the recurve crossbow is eccentric pulleys used. The eccentric pulleys are fixed on two ends of the bow limb assembly, and the bowstring is mounted on the eccentric pulleys and is received in a slot of the eccentric pulleys, such that using a lever principle of the pulleys to pull the bow with heavier pulling force, and the compound crossbow obtains a larger pulling force and higher arrow speed than the recurve crossbow.

Referring to FIGS. 11-13, a compound crossbow 90 contains a crossbow body 91, a bow limb assembly 92, two pulley assemblies 93, a bowstring 94, two auxiliary strings 95, and a cable slide 96.

The crossbow body 91 includes a slot 911 passing therethrough. The bow limb assembly 92 is disposed on the crossbow body 91 and extends from two sides of the bow limb assembly 92. The two pulley assemblies 93 are fixed on two ends of the bow limb assembly 92, and two ends of the bowstring 94 are connected with the two pulley assemblies 93 and orthogonally spanning above the crossbow body 91. The two auxiliary strings 95 are intersected and pass through the slot 911 of the crossbow body 91, and two ends of the two auxiliary strings 95 are connected with the two pulley assemblies 93. The cable slide 96 is slidably received in the slot 911 of the crossbow body 91, and the cable slide 96 has two through orifices 961 parallelly defined adjacent to a bottom of the cable slide 96, wherein one through orifice 961 is located higher than the other through orifice 961, and the two through orifices 961 are configured to accommodate the two auxiliary strings 95, thus separating the two auxiliary strings 95 and forming an intersection A1 of the two auxiliary strings 95 beside the crossbow body 91.

However, the intersection A1 of the two auxiliary strings 95 of the compound crossbow 90 is located beside the crossbow body 91, when the bowstring 94 is pulled tightly backward, loading capacities of the two pulley assemblies 93 and two side of the bow limb assembly 92 are different, thus causing a damage of a balance of the crossbow and to a poor shooting accuracy.

The present invention has arisen to mitigate and/or obviate the afore-described disadvantages.

SUMMARY OF THE INVENTION

The primary object of the present invention is to provide a cable slide structure of a crossbow by which two auxiliary strings are symmetrically fixed among the two pulley assemblies and the cable slide, such that when the bowstring is pulled tightly backward, the cable slide is pulled by the two auxiliary strings, and loading capacities of the two pulley assemblies and two side of the bow limb assembly are equal to avoid a damage of a balance of the crossbow and to enhance shooting accuracy.

To obtain above-mentioned aspect, a cable slide structure of a crossbow provided by the present invention, the crossbow contains: a crossbow body, a bow limb assembly, two pulley assemblies, a bowstring, two auxiliary strings, and cable slide.

The crossbow body includes a holder mounted on a top of the crossbow body, and the crossbow body includes a slot passing therethrough.

The bow limb assembly is fixed on the crossbow body and extends from two sides of the crossbow body.

The two pulley assemblies are connected to two edges of the bow limb assembly.

Two ends of the bowstring are connected with two main locating units of the two pulley assemblies so that the bowstring orthogonally span above the crossbow body.

Each of the two auxiliary strings includes a first connection segment formed on a first end, and a second connection segment formed on a second end of the auxiliary string thereof. Two first connection segments of the two auxiliary strings are connected with the two auxiliary locating units of the two pulley assemblies.

The cable slide is slidably received in the slot of the crossbow body, and the cable slide includes two opposite first fixing portions extending from a first side of the cable slide, two opposite second fixing portions extending from a second side of the cable slide. Two second connection segments of the two auxiliary strings roll across the two opposite second fixing portions of the cable slide to connect with the two opposite first fixing portions of the cable slide so that the two auxiliary strings are fixed among the two pulley assemblies and the cable slide.

DETAILED DESCRIPTION OF THE PREFERRED EMBODIMENTS

Figure 1:
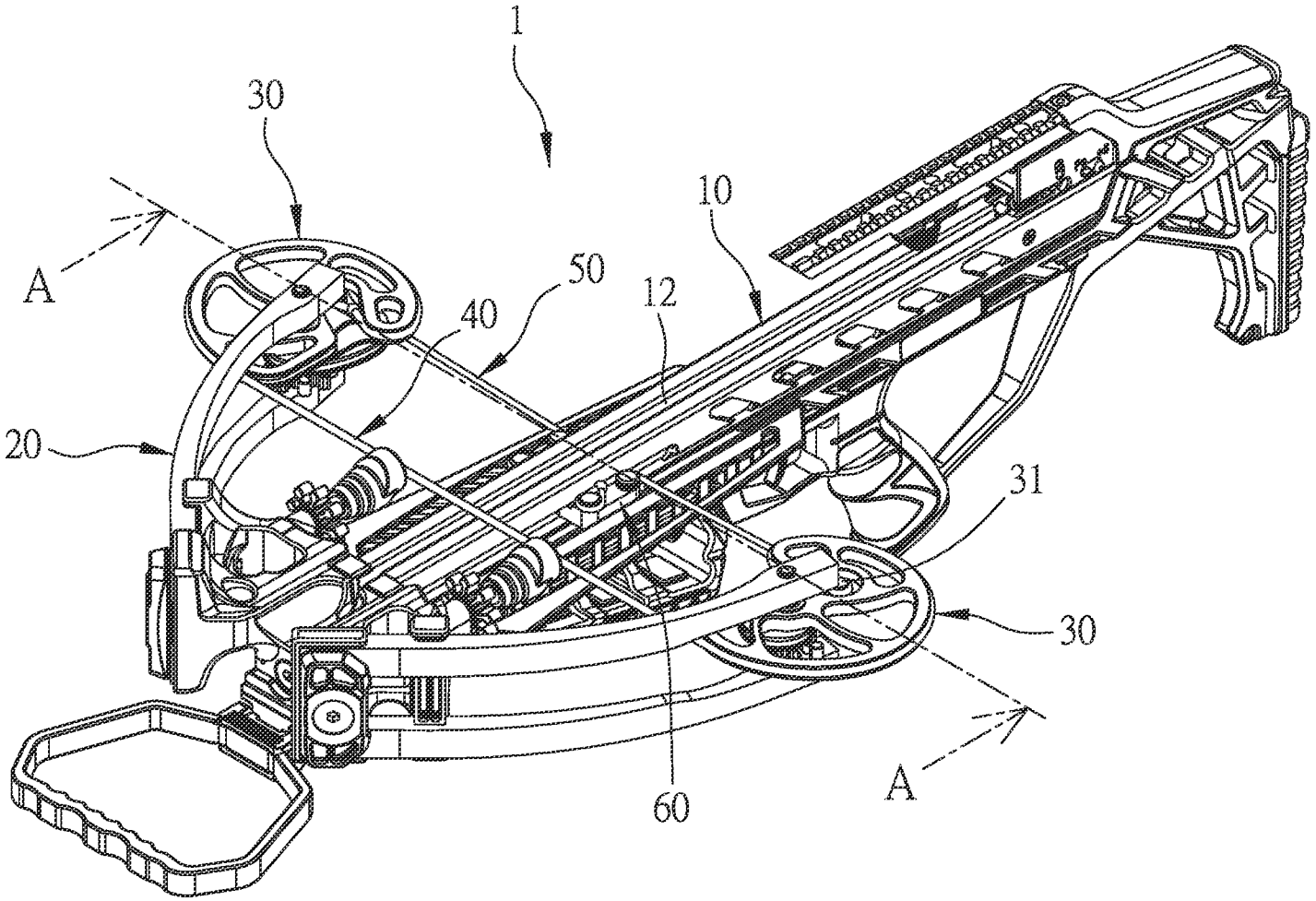
FIG. 1 is a perspective view showing the assembly of a crossbow according to a preferred embodiment of the present invention.
Figure 2:
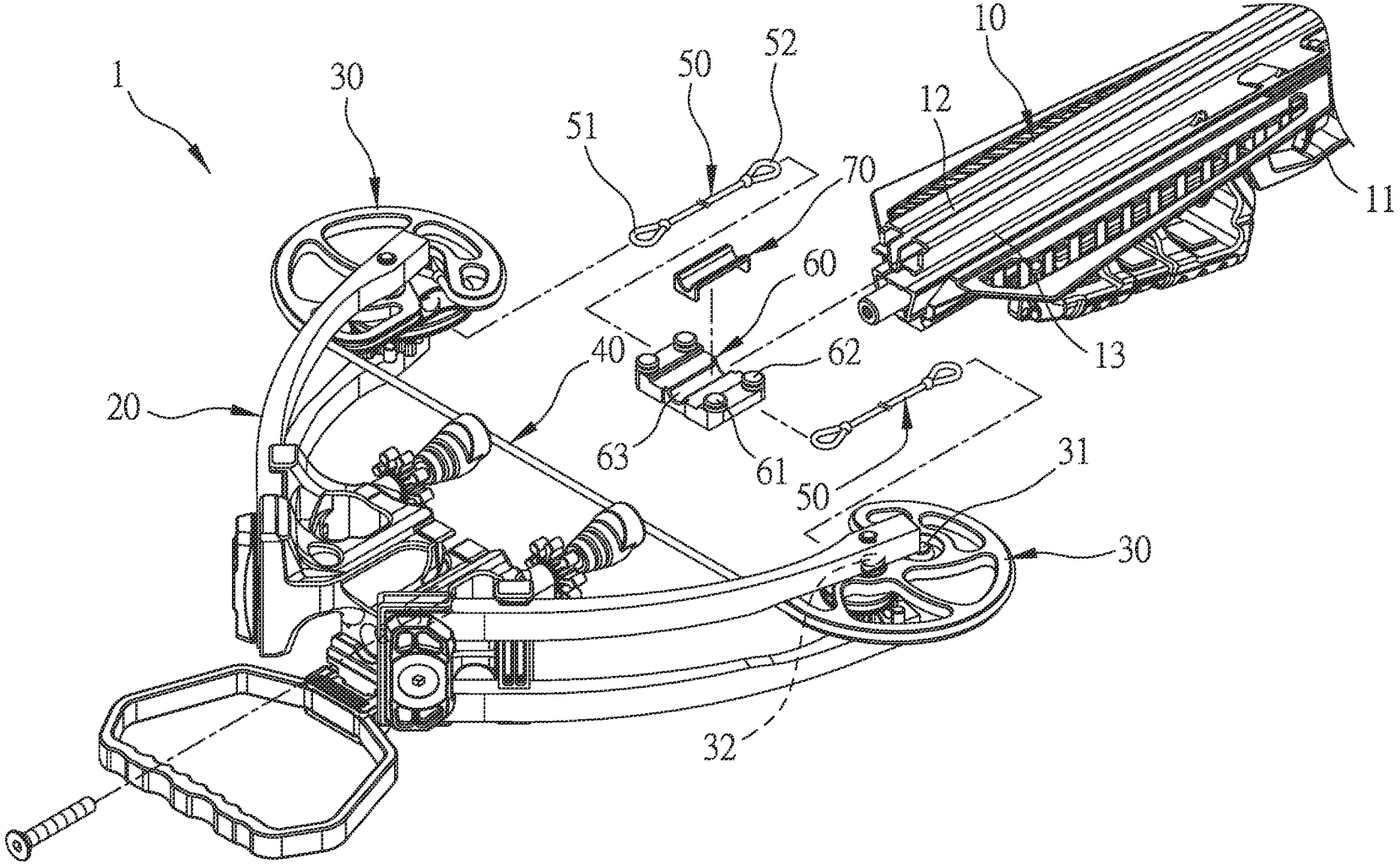
FIG. 2 is a perspective view showing the exploded components of the crossbow according to the preferred embodiment of the present invention.
Figure 3:
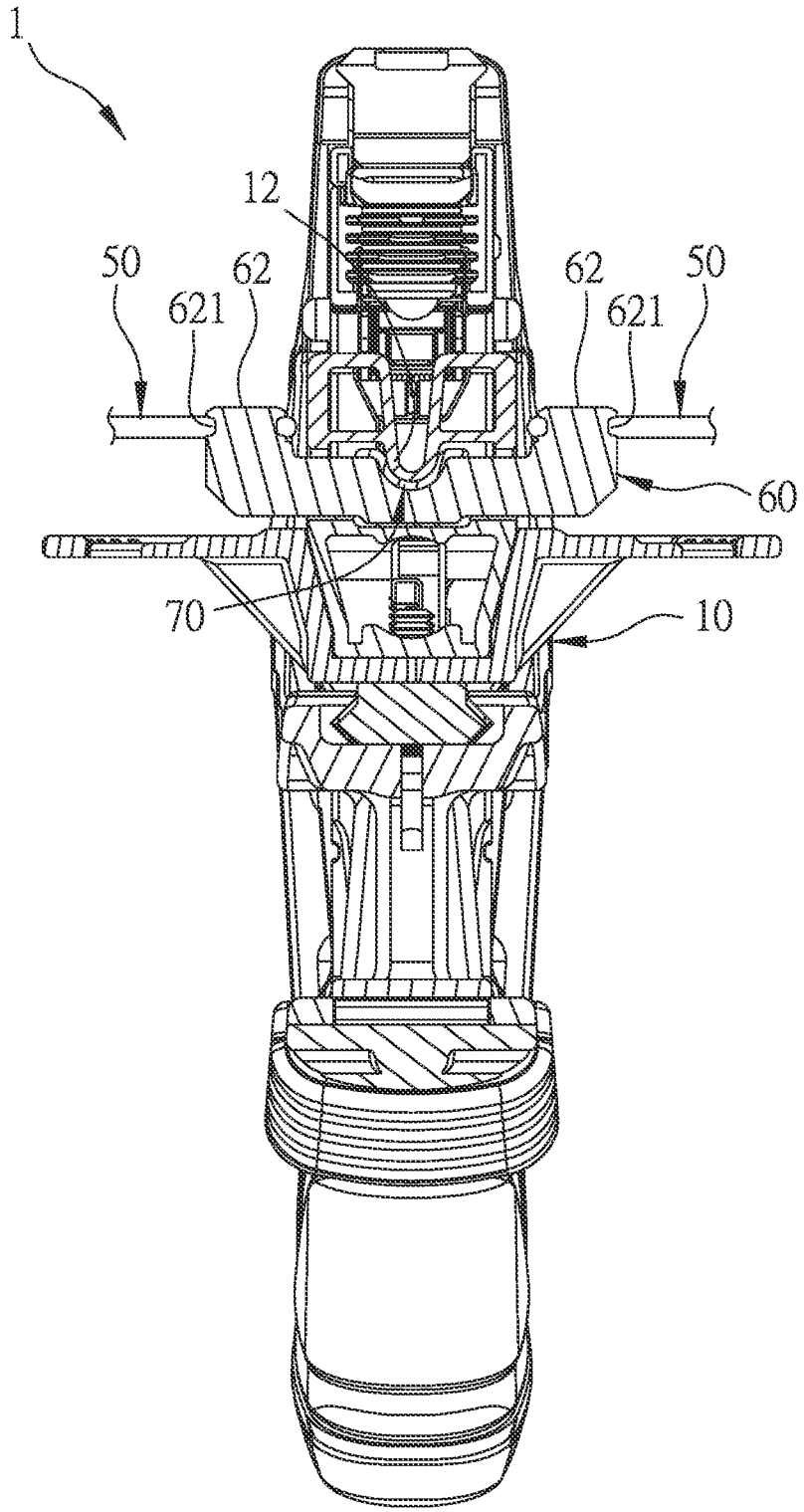
FIG. 3 is a cross sectional view taken along the line A-A of FIG. 1.
Figure 4:
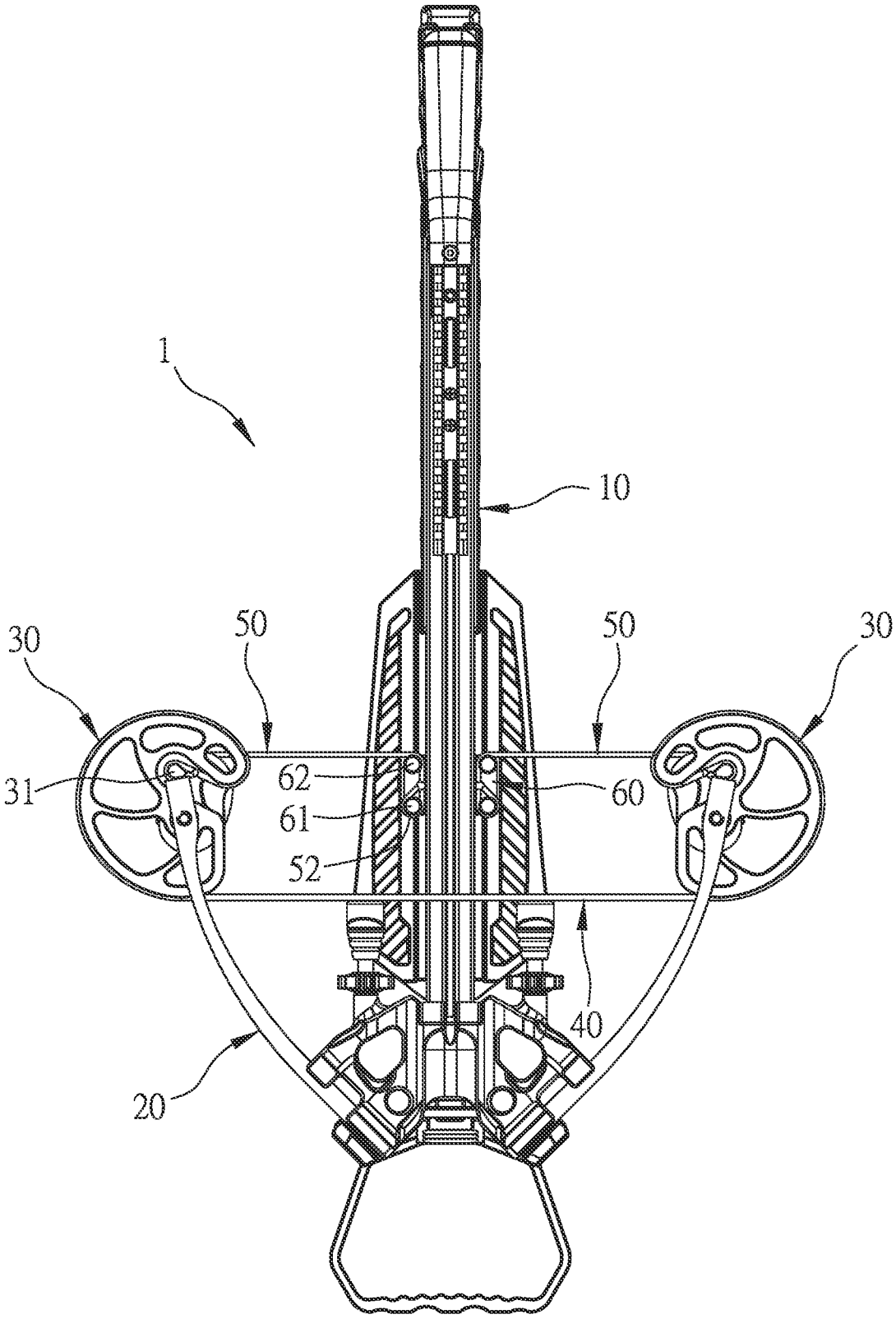
FIG. 4 is a top plan view showing the assembly of the crossbow according to the preferred embodiment of the present invention.
Figure 5:
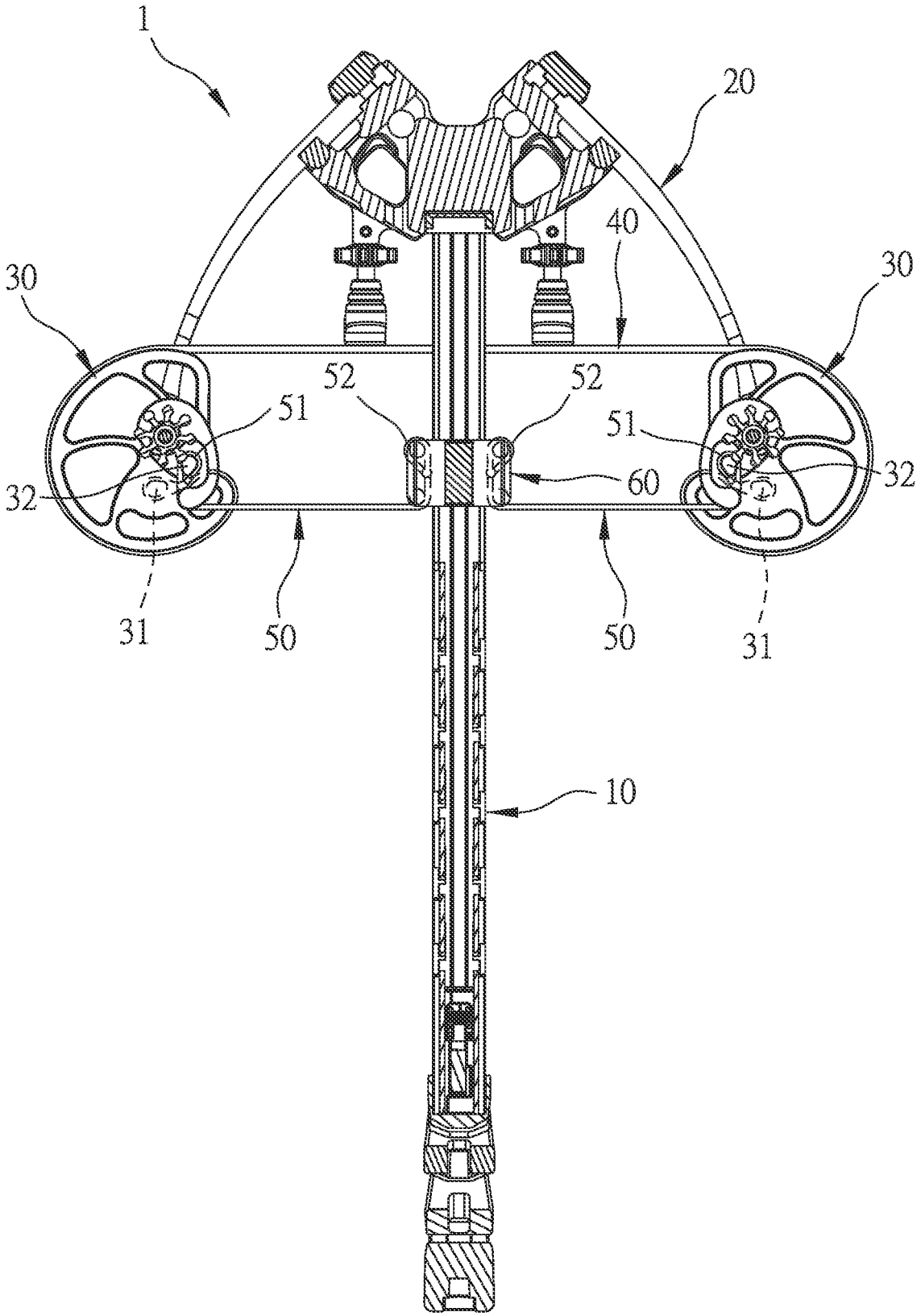
FIG. 5 is a cross sectional view showing the assembly of the crossbow according to the preferred embodiment of the present invention.
Figure 6:
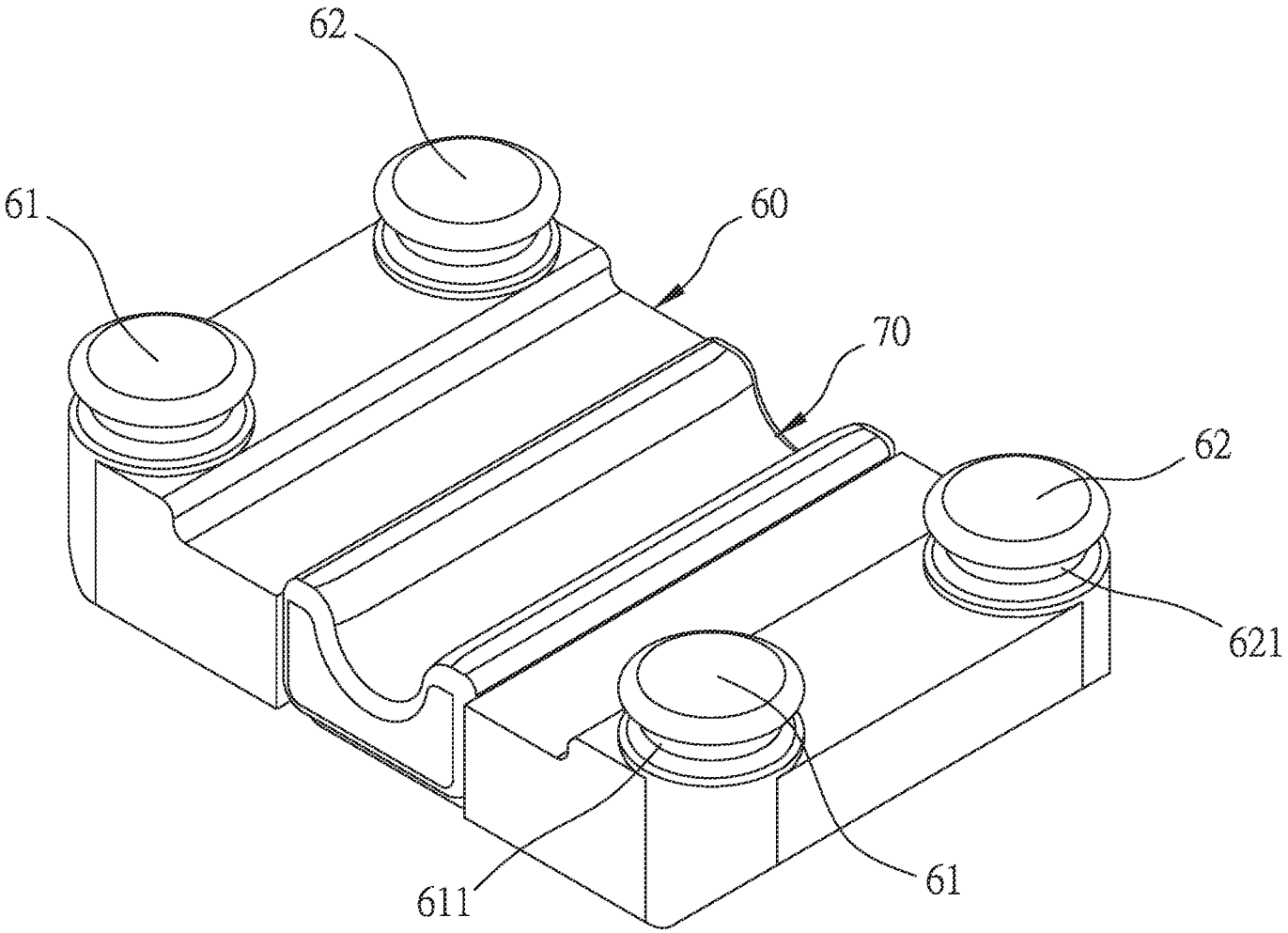
FIG. 6 is a perspective view showing the assembly of a cable slide of the crossbow according to the preferred embodiment of the present invention.
Figure 7:
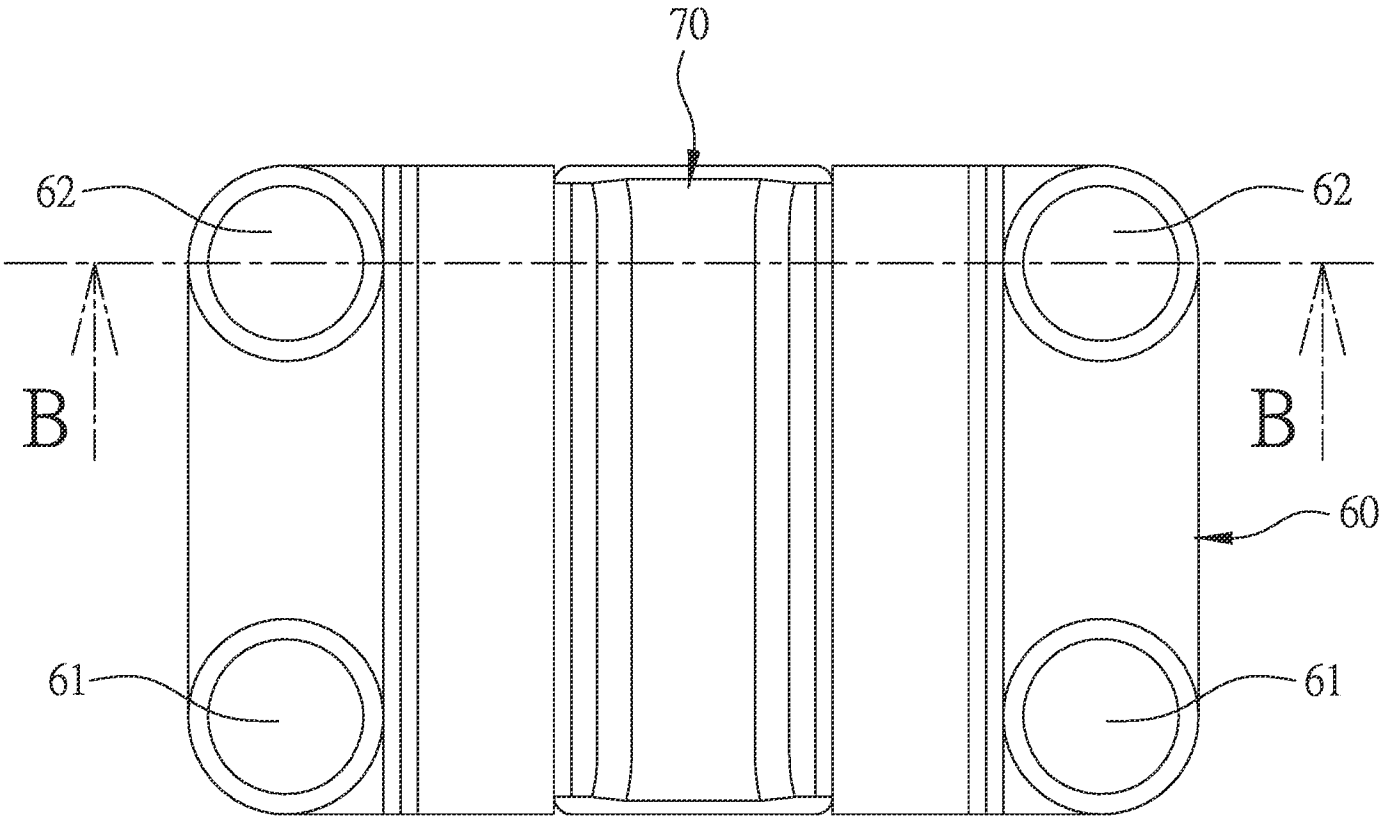
FIG. 7 is a top plan view showing the assembly of the cable slide of the crossbow according to the preferred embodiment of the present invention.
Figure 8:
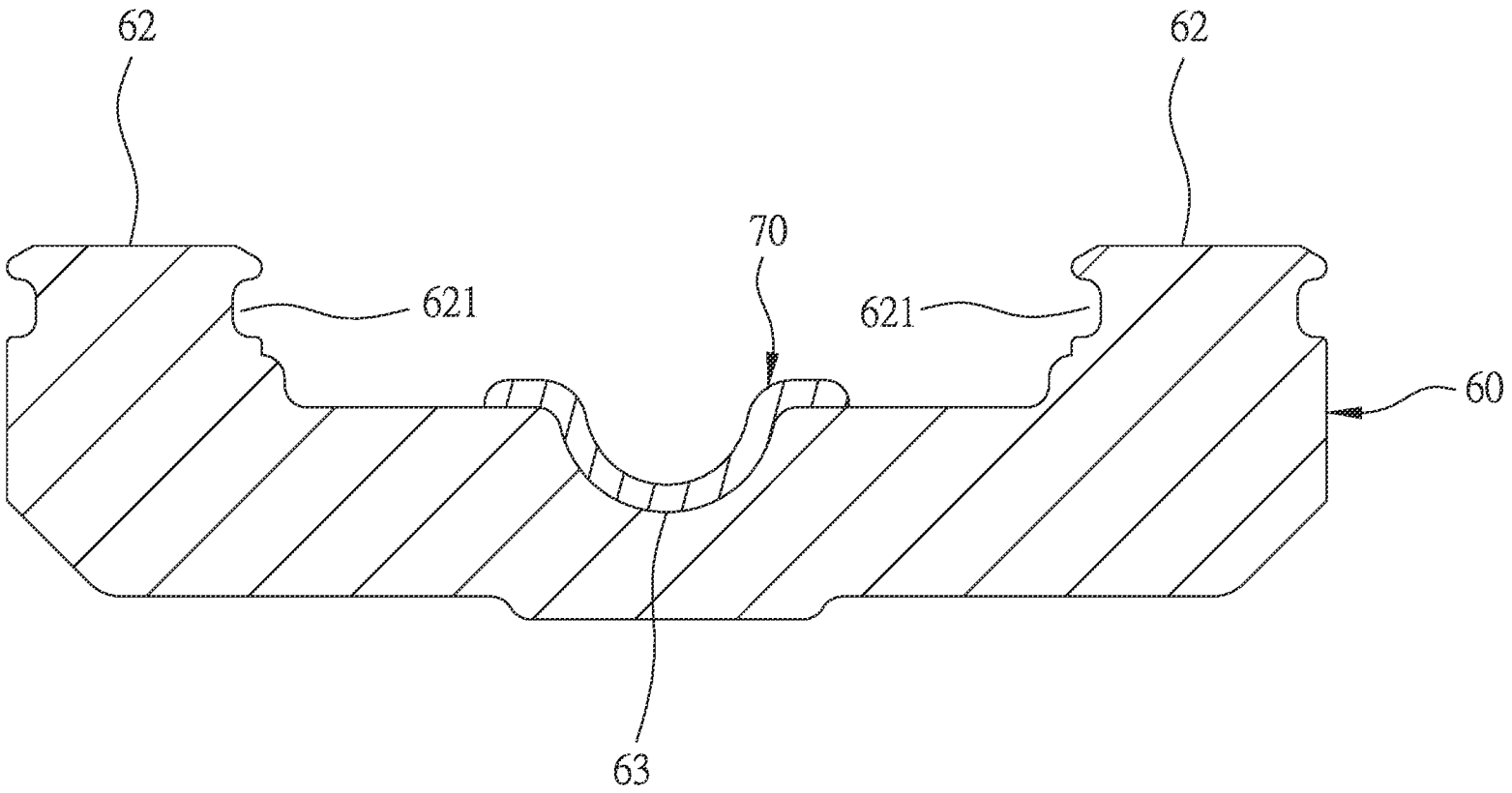
FIG. 8 is a cross sectional view taken along the line B-B of FIG. 7.

The present invention will be clearer from the following description when viewed together with the accompanying drawings, which show, for purpose of illustrations only, a preferred embodiment in accordance with the present invention.

With reference to FIGS. 1-8, a cable slide structure of a crossbow 1 according to a preferred embodiment of the present invention, the crossbow 1 comprises: a crossbow body 10, a bow limb assembly 20, two pulley assemblies 30, a bowstring 40, two auxiliary strings 50, a cable slide 60, and a protective cap 70.

The crossbow body 10 is made of metal and includes a trigger set 11, a holder 12 forms an U-shaped mounted on a top of the crossbow body 10, and a slot 13 passing through the crossbow body 10.

The bow limb assembly 20 is fixed on the crossbow body 10 and extending from two sides of the crossbow body 10.

The two pulley assemblies 30 are symmetrically connected to two edges of the bow limb assembly 20, and each of the two pulley assemblies 30 includes a main locating unit 31 and an auxiliary locating unit 32, the main locating unit 31 is a column defined on the top surface of the pulley assembly 30, and the auxiliary locating unit 32 is a column defined at the bottom surface of the pulley assembly 30.

Two ends of the bowstring 40 roll around two outer peripheries of the two pulley assemblies 30 and are connected with two main locating units 31 of the two pulley assemblies 30 so that the bowstring 40 orthogonally span above the crossbow body 10.

Two auxiliary strings 50, each of the two auxiliary strings 50 includes a first connection segment 51 formed on a first end, and a second connection segment 52 formed on a second end of the auxiliary string 50 thereof, wherein two first connection segments 51 of the two auxiliary strings 50 are connected with two auxiliary locating units 32 of the two pulley assemblies 30.

The cable slide 60 is made of metal and is slidably received in the slot 13 of the crossbow body 10, and the cable slide 60 is formed in a rectangle shape, wherein the cable slide 60 includes two opposite first fixing portions 61 extending from a first side thereof, two opposite second fixing portions 62 extending from a second side of the cable slide 60, and an arcuate groove 63 defined on a center of a top of the cable slide 60 and being parallel to the crossbow body 10, wherein each of the two first fixing portions 61 is a first column, and each of the two second fixing portions 62 is a second column, wherein the first column has a first trench 611 defined around a peripheral wall thereof, and the second column has a second trench 621 defined around a peripheral wall thereof, such that two second connection segments 52 of the two auxiliary strings 50 roll across the two opposite second fixing portions 62 of the cable slide 60 to connect with the two opposite first fixing portions 61 of the cable slide 60 so that the two auxiliary strings 50 are fixed among the two pulley assemblies 30 and the cable slide 60.

The protective cap 70 contacts with the arcuate groove 63 of the cable slide 60, wherein a hardness of the protective cap 70 is less than a hardness of the cable slide 60 and the crossbow body 10 so as to avoid the cable slide 60 contacting with a bottom of the holder 12 of the crossbow body 10 directly.

Figure 9:
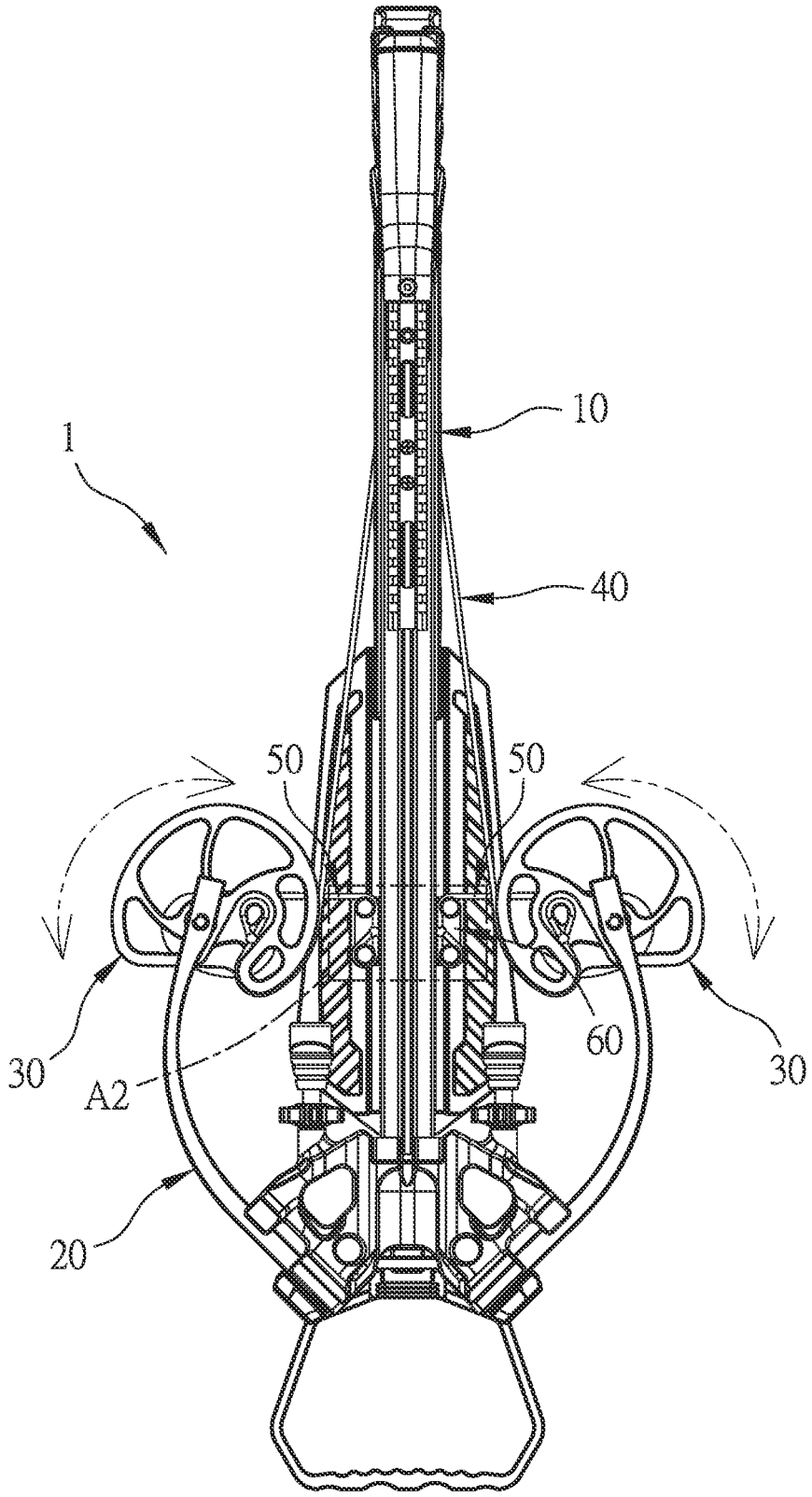
FIG. 9 is a top plan view showing the operation of the crossbow according to the preferred embodiment of the present invention.

When desiring to tighten a bowstring, as shown in FIG. 9, the bowstring 40 is pulled away from the bow limb assembly 20 to actuate the two pulley assemblies 30 to rotate, and the bow limb assembly 20 is bended and deformed, wherein the cable slide 60 is moved along the slot 13 of the crossbow body 10 so that the bowstring 40 is pulled to engage with the trigger set 11, and an arrow is put in the holder 12 of the crossbow body 10 to contact with the bowstring 40. Then, a user aims at a target and triggers the trigger set 11 so that the bowstring 40 is removed from the trigger set 11, and the bow limb assembly 20 is not pulled to bounce backward, hence the bowstring 40 drives the arrow to shoot from the crossbow body 10 quickly and forcefully.

Figure 10:
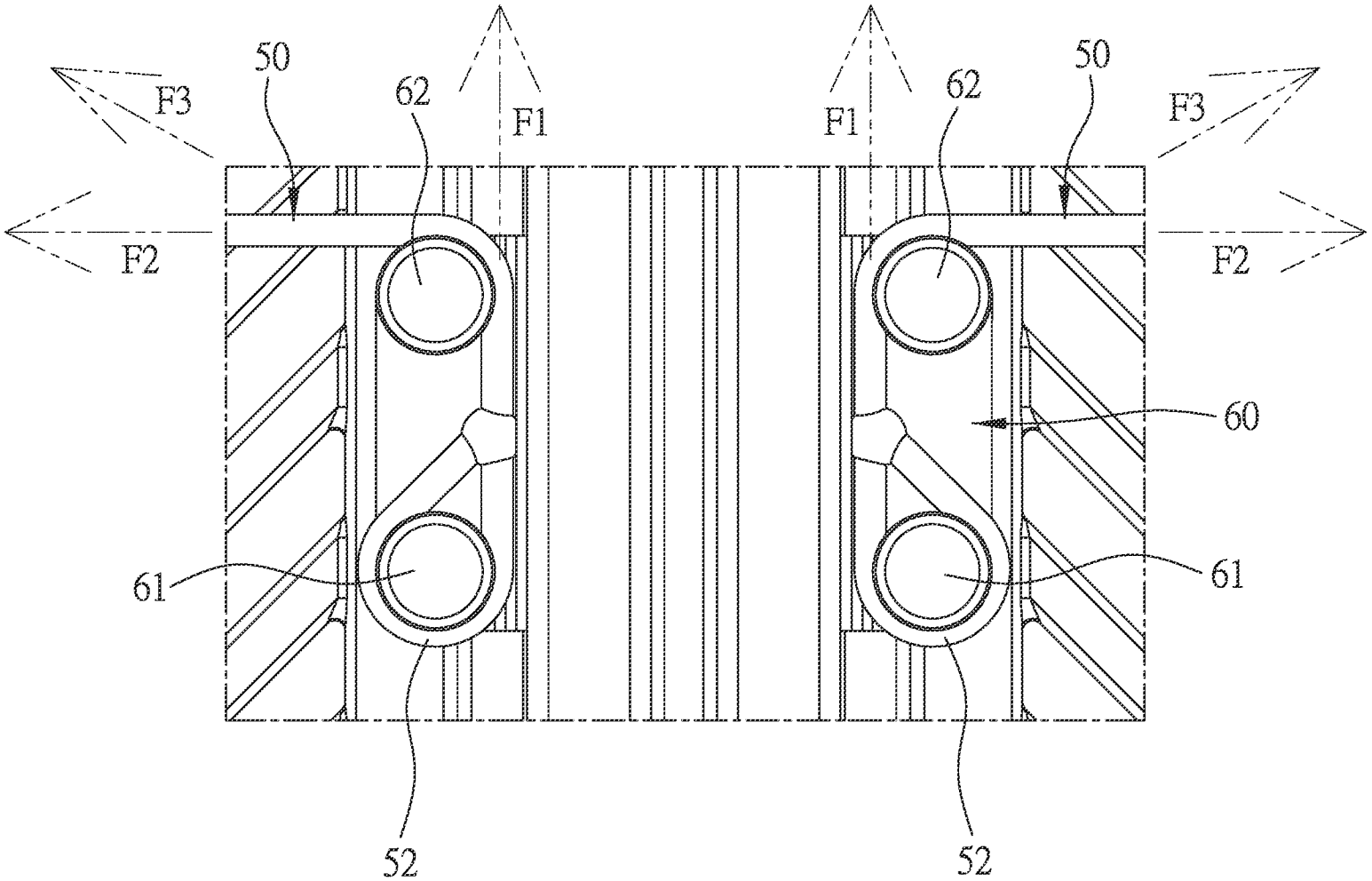
FIG. 10 is an amplified view of a portion A2 of FIG. 9.
Figure 11:
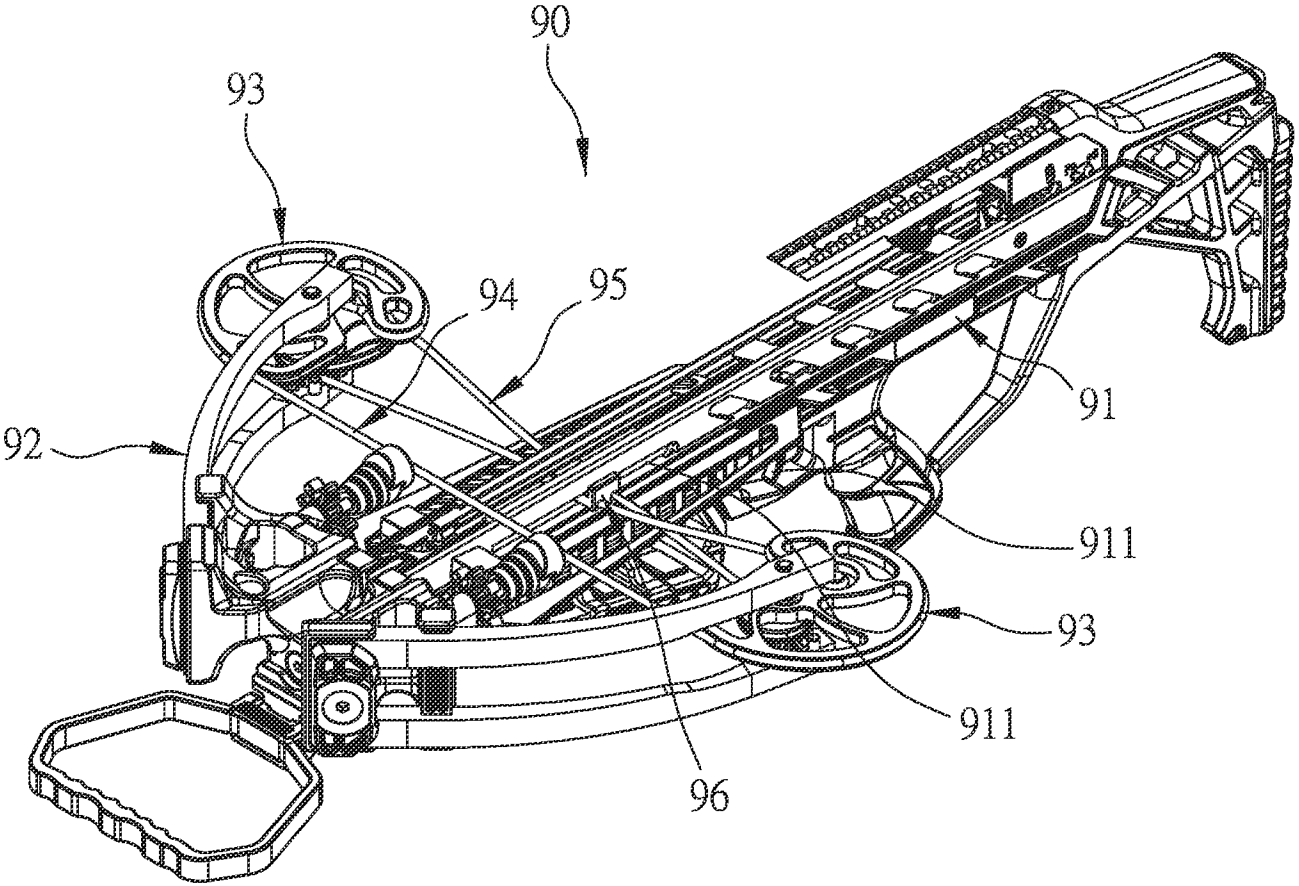
FIG. 11 PRIOR ART
FIG. 11 is a perspective view of a conventional crossbow.
Figure 12:
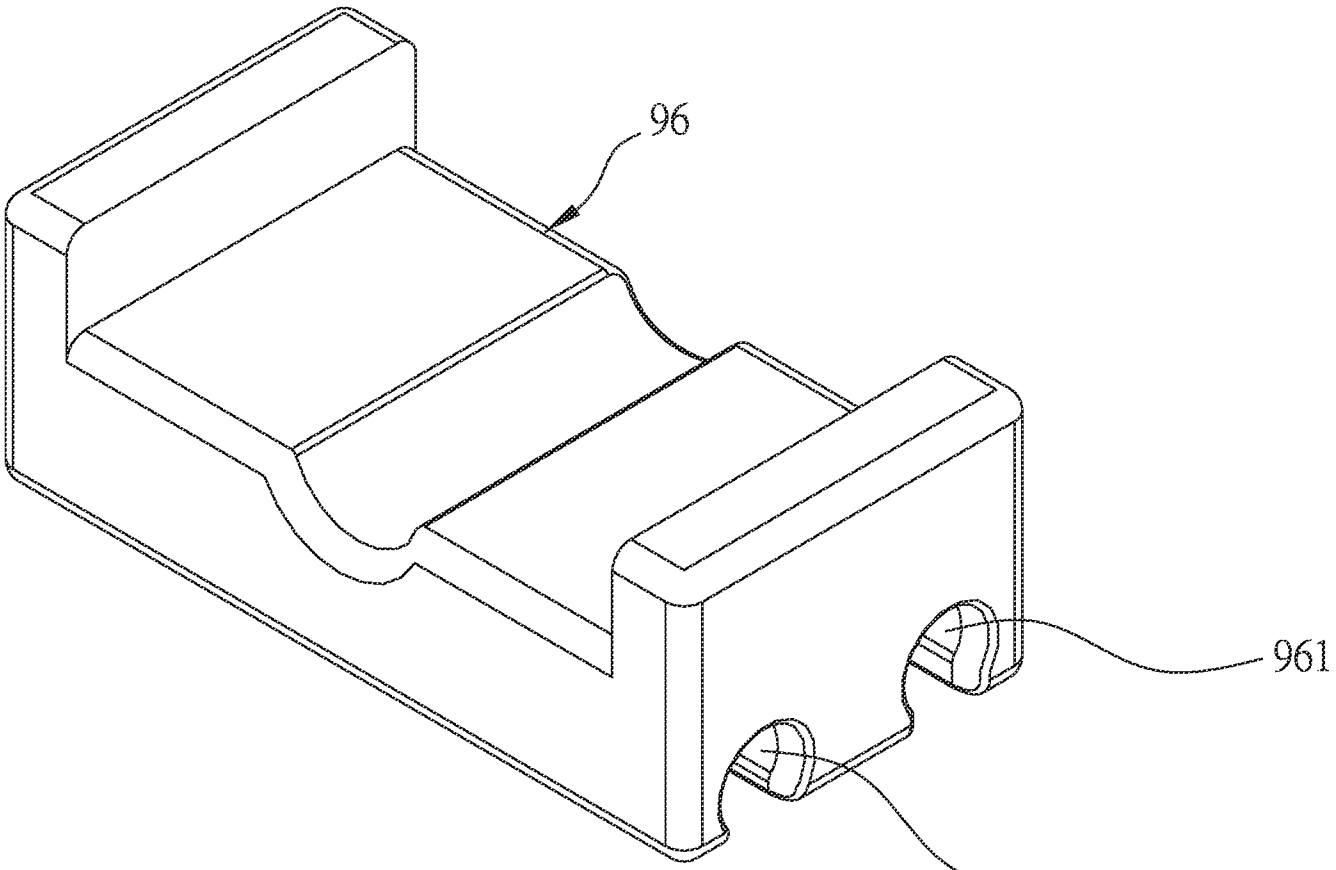
FIG. 12 PRIOR ART
FIG. 12 is a perspective view of a cable slide of the conventional crossbow.
Figure 13:
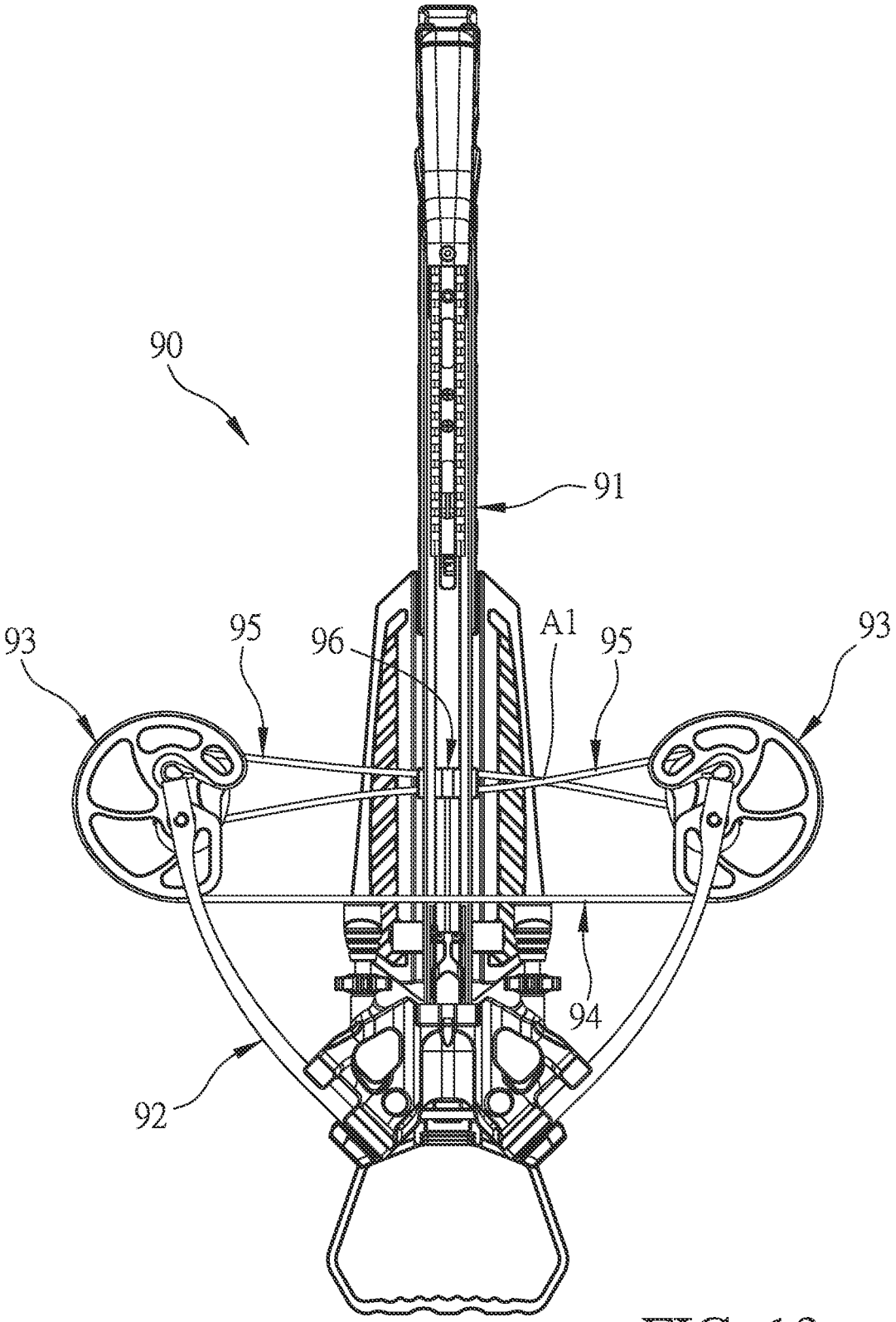
FIG. 13 PRIOR ART
FIG. 13 is a top plan view of the conventional crossbow.

When the bowstring 40 is pulled to engage with the trigger set 11, the two auxiliary strings 50 are rotated tightly by the two pullet assemblies 30 so that the two second connection segments 52 of the two auxiliary strings 50 roll across the two opposite second fixing portions 62 of the cable slide 60 to connect with the two opposite first fixing portions 61 of the cable slide 60, and a first pull force F1 parallel to the crossbow body 10 and a second pull force F2 perpendicular to the crossbow body 10 produce when the two sides of the cable slide 60 are pulled by the two auxiliary strings 50 (as illustrated in FIG. 10). Furthermore, an obliquely third pull force F3 produces by combining the first pull force F1 and the second pull force F2, thus avoiding deformation of the slide able 60 when the two auxiliary strings 50 pull the cable slide 60.

Accordingly, the cable slide structure of the crossbow of the present invention has advantages as follows:

The two auxiliary strings 50 are symmetrically fixed among the two pulley assemblies 30 and the cable slide 60, so when the bowstring 40 is pulled tightly backward, the cable slide 60 is pulled by the two auxiliary strings 50, and loading capacities of the two pulley assemblies 30 and two side of the bow limb assembly 20 are equal to avoid a damage of a balance of the crossbow 1 and to enhance shooting accuracy.

While various embodiments in accordance with the present invention have been shown and described, it is clear to those skilled in the art that further embodiments may be made without departing from the scope of the present invention.

What is claimed is:

1. A cable slide structure of a crossbow, the crossbow comprising:

a crossbow body including a holder mounted on a top of the crossbow body, and a slot passing through the crossbow body;

a bow limb assembly fixed on the crossbow body and extending from two sides of the crossbow body;

two pulley assemblies connected to two edges of the bow limb assembly, each of two pulley assemblies includes a main locating unit and an auxiliary locating unit;

a bowstring, two ends of which are connected with two main locating units of the two pulley assemblies so that the bowstring orthogonally span above the crossbow body;

two auxiliary strings, each of the two auxiliary strings includes a first connection segment formed on a first end and a second connection segment formed on a second end of the auxiliary string, wherein two first connection segments of the two auxiliary strings are connected with the two auxiliary locating units of the two pulley assemblies; and a cable slide slidably received in the slot of the crossbow body, and the cable slide including two opposite first fixing portions extending from a first side of the cable slide, two opposite second fixing portions extending from a second side of the cable slide, wherein the two second connection segments of the two auxiliary strings roll across the two opposite second fixing portions of the cable slide to connect with the two opposite first fixing portions of the cable slide so that the two auxiliary strings are fixed among the two pulley assemblies and the cable slide.

2. The cable slide structure of a crossbow as claimed in claim 1, wherein the cable slide is formed in a rectangle shape, and the cable slide includes an arcuate groove defined on a center of a top of the cable slide and being parallel to the crossbow body, wherein each of the two first fixing portions is a first column, and each of the two second fixing portions is a second column.

3. The cable slide structure of a crossbow as claimed in claim 2, wherein the first column has a first trench defined around a peripheral wall thereof, and the second column has a second trench defined around a peripheral wall thereof.

4. The cable slide structure of a crossbow as claimed in claim 2, wherein the crossbow further comprises a protective cap contacting with the arcuate groove of the cable slide, wherein a hardness of the protective cap is less than a hardness of the cable slide and the crossbow body so as to avoid the cable slide contacting with a bottom of the holder of the crossbow body directly.

5. The cable slide structure of a crossbow as claimed in claim 1, wherein each main locating unit is a column defined on a top surface of a corresponding pulley assembly.

6. The cable slide structure of a crossbow as claimed in claim 1, wherein each main locating unit is a column defined on a bottom surface of a corresponding pulley assembly.

* * * * *